US007029104B2

(12) United States Patent
Sakai et al.

(10) Patent No.: US 7,029,104 B2
(45) Date of Patent: Apr. 18, 2006

(54) INK CARTRIDGE AND RECORDING APPARATUS

(75) Inventors: Yasuto Sakai, Nagano (JP); Koichi Toba, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 10/290,471

(22) Filed: Nov. 8, 2002

(65) Prior Publication Data

US 2003/0085970 A1 May 8, 2003

(30) Foreign Application Priority Data

Nov. 8, 2001 (JP) ..... P2001-343583

(51) Int. Cl.
*B41J 2/175* (2006.01)
*B41J 29/393* (2006.01)

(52) U.S. Cl. ..... 347/86; 347/19

(58) Field of Classification Search ..... 347/19, 347/85, 86, 87

See application file for complete search history.

(56) References Cited

U.S. PATENT DOCUMENTS

| | | | | |
|---|---|---|---|---|
| 5,365,312 | A * | 11/1994 | Hillmann et al. | 399/12 |
| 5,699,091 | A | 12/1997 | Bullock et al. | |
| 5,788,388 | A * | 8/1998 | Cowger et al. | 400/703 |
| 6,065,824 | A * | 5/2000 | Bullock et al. | 347/19 |
| 6,158,837 | A | 12/2000 | Hilton et al. | |

FOREIGN PATENT DOCUMENTS

| | | | |
|---|---|---|---|
| EP | 072916 | A2 | 7/1996 |
| EP | 0720916 | A2 | 7/1996 |
| EP | 0812693 | A1 | 12/1997 |
| EP | 0960736 | A1 | 12/1999 |
| EP | 0985537 | A1 | 3/2000 |
| JP | 04315336 | | 6/1994 |
| JP | 06155758 | | 6/1994 |

* cited by examiner

*Primary Examiner*—Anh T.N. Vo
(74) *Attorney, Agent, or Firm*—Sughrue Mion, PLLC

(57) ABSTRACT

An ink cartridge which supplies ink to a recording apparatus, comprises an ink cartridge body for storing ink therein, a supply system for supplying the ink stored in the ink cartridge body to the recording apparatus, and an identification system that is provided for the ink cartridge body and includes data regarding the supply system for supplying the ink to the recording apparatus.

8 Claims, 13 Drawing Sheets

INK CARTRIDGE AND RECORDING APPARATUS

BACKGROUND OF THE INVENTION

The present invention relates to an ink cartridge and a recording apparatus. More particularly, the invention relates to an ink cartridge that supplies ink to a recording apparatus, and a recording apparatus to which this ink cartridge is attached.

In a recording apparatus such as an ink jet recording apparatus, an ink cartridge storing ink therein is mounted on a carriage of the recording apparatus, whereby ink is supplied to the recording apparatus.

The ink cartridge used in this recording apparatus has been described, for example, in Japanese Patent Publication No. Hei. 8-174860. This ink cartridge uses a membrane valve as an ink supply system, and operates the membrane valve by difference between pressure on the recording apparatus side and pressure on the inside of the ink cartridge thereby to supply ink. In the ink cartridge using the membrane valve, since the special structure is unnecessary for the container inside in which ink is stored in order to hold the ink, a comparatively large quantity of ink can be stored. Further, this ink cartridge is high in ink supply performance to a recording head of the recording apparatus in comparison with another ink cartridge using a foam (described later), and therefore has a characteristic of being suitably applicable to a recording head for executing high speed printing.

As another example of the ink cartridge, a foam, such as urethane foam, functioning as an ink holding system is housed in a container body of an ink cartridge, and ink is supplied using capillary force of the foam. In the ink cartridge using the foam, holding power of ink is high and ink is difficult to drip. However, since the, resistance of the ink flowing passage is high, the ink flowing amount is limited. Further, all of the ink held in pores of the foam is not supplied to the recording apparatus, and ink shortage frequently occurs in a state where the ink remains.

If the ink cartridge using the foam has the same outline as the ink cartridge using the differential pressure system, the former can be mounted on the carriage of the recording apparatus to which the latter is to be mounted.

Further, it these ink cartridges are the same as each other in the outline, the ink cartridge using the differential pressure system can be also mounted on the carriage of the recording apparatus to which the ink cartridge using the foam is to be mounted.

However, when the ink cartridge using the foam is mounted on the recording apparatus adjusted so as to become optimum in case that the ink is supplied by the ink cartridge using the differential pressure system, the recording apparatus does not always operate optimally. For example, the ink cartridge cannot frequently supply the ink flowing amount which the recording apparatus (the recording head) requires. Further, in case that the amount of the ink remaining really in the ink cartridge is different from the recordable amount using its residual ink, the recordable amount is not calculated correctly and end detection of the ink residual amount becomes inaccurate.

Similarly, when the ink cartridge using the differential pressure system is mounted on the recording apparatus adjusted so as to become optimum in case that the ink is supplied by the ink cartridge using the foam, the recording apparatus does not always operate optimally.

SUMMARY OF THE INVENTION

Therefore, an object of the invention is to provide an ink cartridge and a recording apparatus that can solve the problems. This object is achieved by combination of features described in independent claims in the scope of the patent claims. Further, dependent claims specify more advantageous embodiments of the invention.

Namely, according to the first aspect of the invention, an ink cartridge which supplies ink to a recording apparatus, comprises an ink cartridge body for storing the ink therein, a supply system for supplying the ink stored in the ink cartridge body to the recording apparatus, and an identification system that is provided for the ink cartridge body and includes data regarding the supply system for supplying the ink to the recording apparatus.

In the ink cartridge, the supply system may include either an ink holding system or a differential pressure system, and the identification system may include data of whether the supply system is the ink holding system or the differential pressure system.

In the ink cartridge, the identification system may include an IC mounted on the ink cartridge body.

In the ink cartridge, the identification system may include an outline of the ink cartridge body.

According to the second aspect of the invention, a recording apparatus in which ink is supplied by an ink supply system of an ink cartridge from said ink cartridge, comprises a carriage housing the ink cartridge therein, and a judgment system for judging the ink supply system of the ink cartridge housed in the carriage.

In the recording apparatus, the judgment system may include a reading system for reading out data from an IC provided for the ink cartridge.

In the recording apparatus, the judgment system may include an outline judging system for judging an outline of the ink cartridge.

In the summary of the invention, all of necessary features of the invention are not described but sub-combination of these features can also become the invention.

The present disclosure relates to the subject matter contained in Japanese patent application No. P2001-343583 (filed on Nov. 8, 2001), which is expressly incorporated herein by reference in its entirety.

DESCRIPTION OF THE PREFERRED EMBODIMENT

The invention will be described below through embodiments of the invention. However, the following embodiments do not limit the invention according to claims, and all combination of features described in the embodiments are not essential to means for solving the problems according to the invention.

Figure 1:
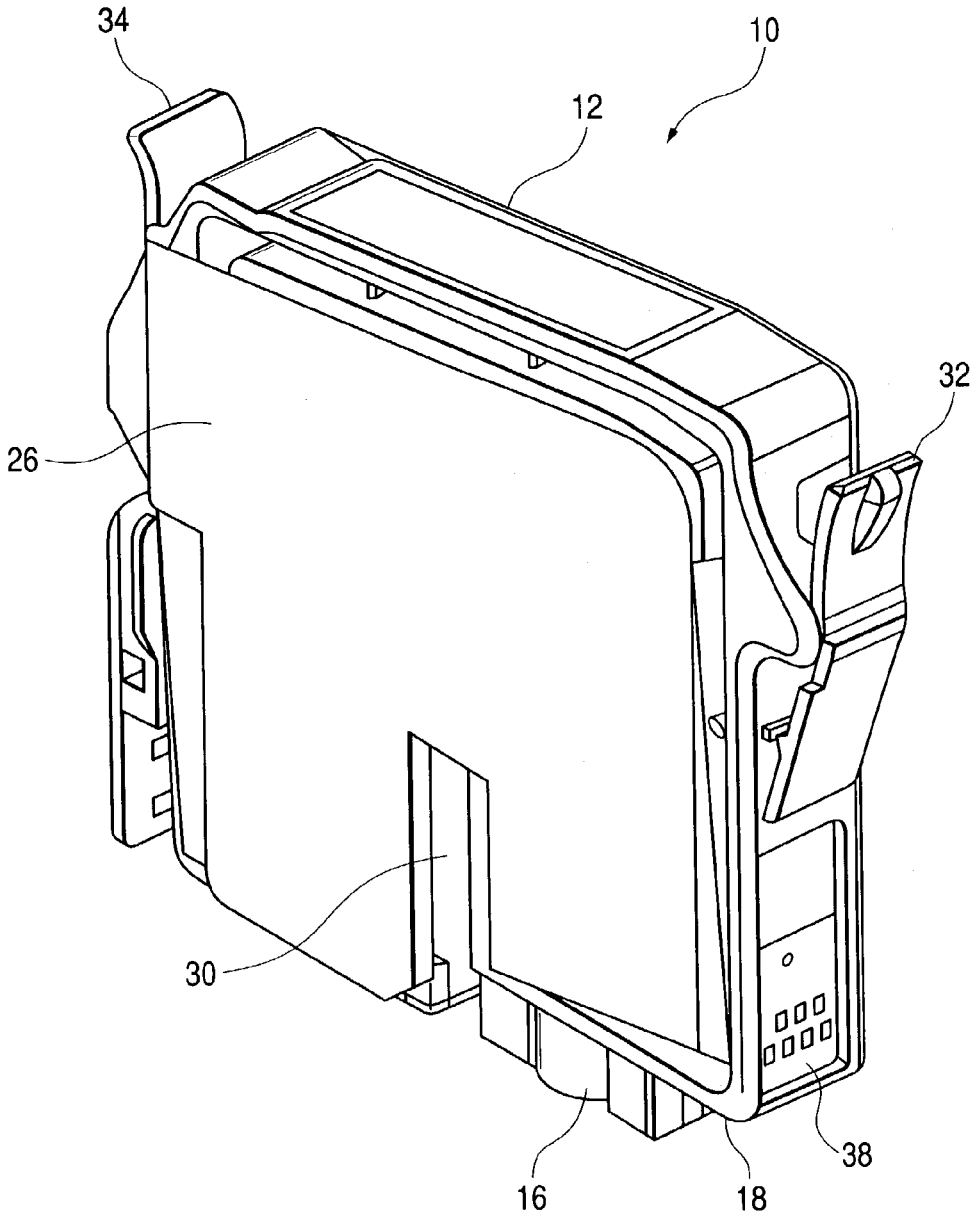
FIG. 1 is a front perspective view of an ink cartridge according to a first embodiment of the invention.
Figure 2:
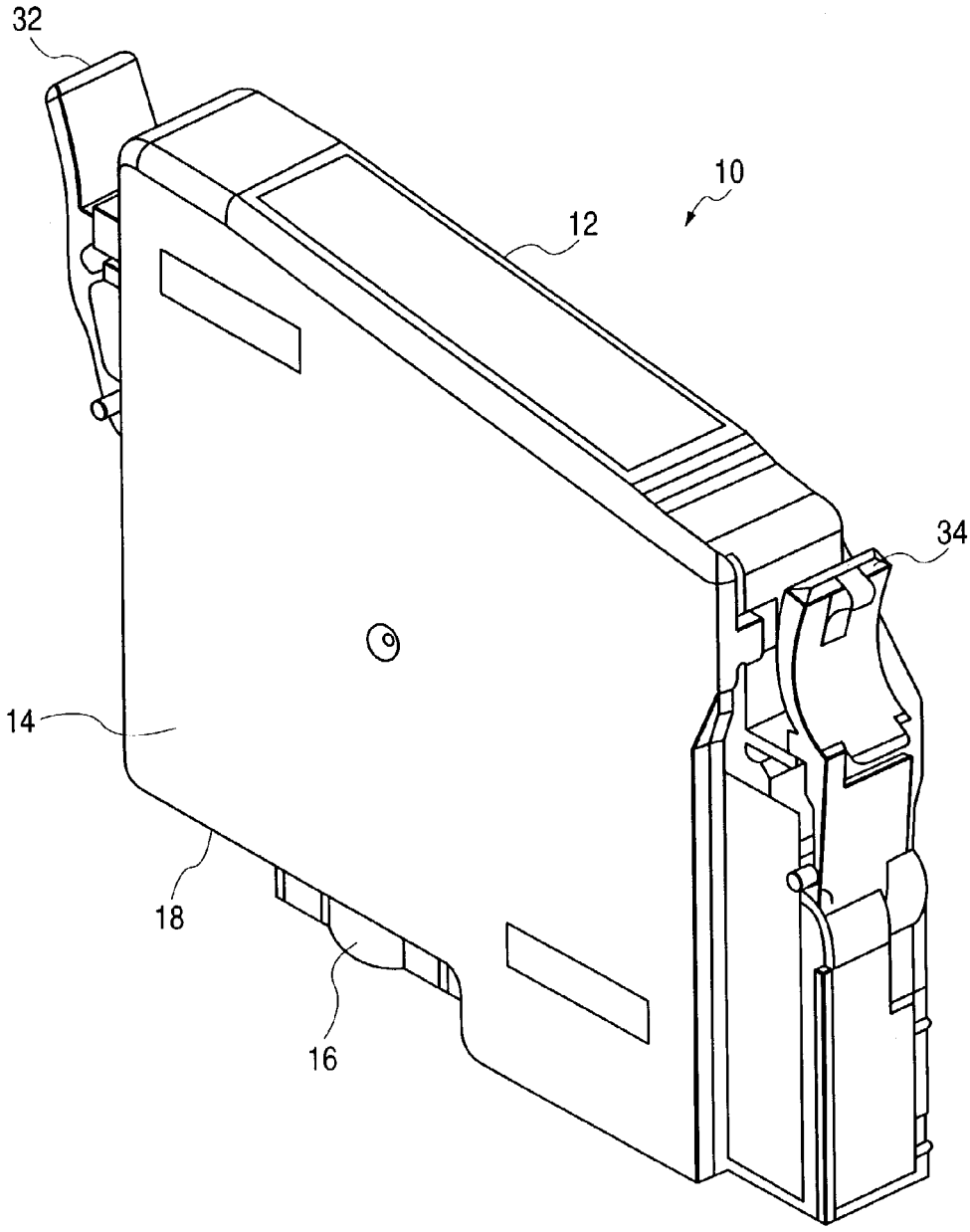
FIG. 2 is a back perspective view of the ink cartridge in FIG. 1.

FIG. 1 is a front perspective view of an ink cartridge according to a first embodiment of the invention. FIG. 2 is a back perspective view of the ink cartridge in FIG. 1. An ink cartridge 10 according to the first embodiment is an ink cartridge for supplying ink to an ink jet recording apparatus, and includes an ink cartridge body 12 storing ink therein.

The ink cartridge body 12 comprises a container body 13 and a lid member 14, and has an outline of an approximately rectangular hexahedron as a whole. The container body 13 has an ink supply surface 18 including an ink supply passage 16 to which an ink supply needle of the ink jet recording apparatus is inserted.

In the vicinity of the ink supply passage 16 and in the center of the container body, a slit portion 30 extending from the ink supply surface 18 of the container body 13 in the insertion direction of the ink supply needle is provided. By this slit portion 30, in case that the ink supply needle is inserted into the ink cartridge 10, the opening surface of the ink supply passage 16 is regulated so as to be orthogonal to the ink supply needle before the leading end of the ink supply passage 16 reaches the ink supply needle, so that the ink supply needle can be surely inserted into the ink supply passage 16.

At the upper portions of side surfaces of the container body 13, retaining members 32 and 34 respectively engaging the carriage of the ink jet recording apparatus are formed integrally with the container body 13.

Figure 3:
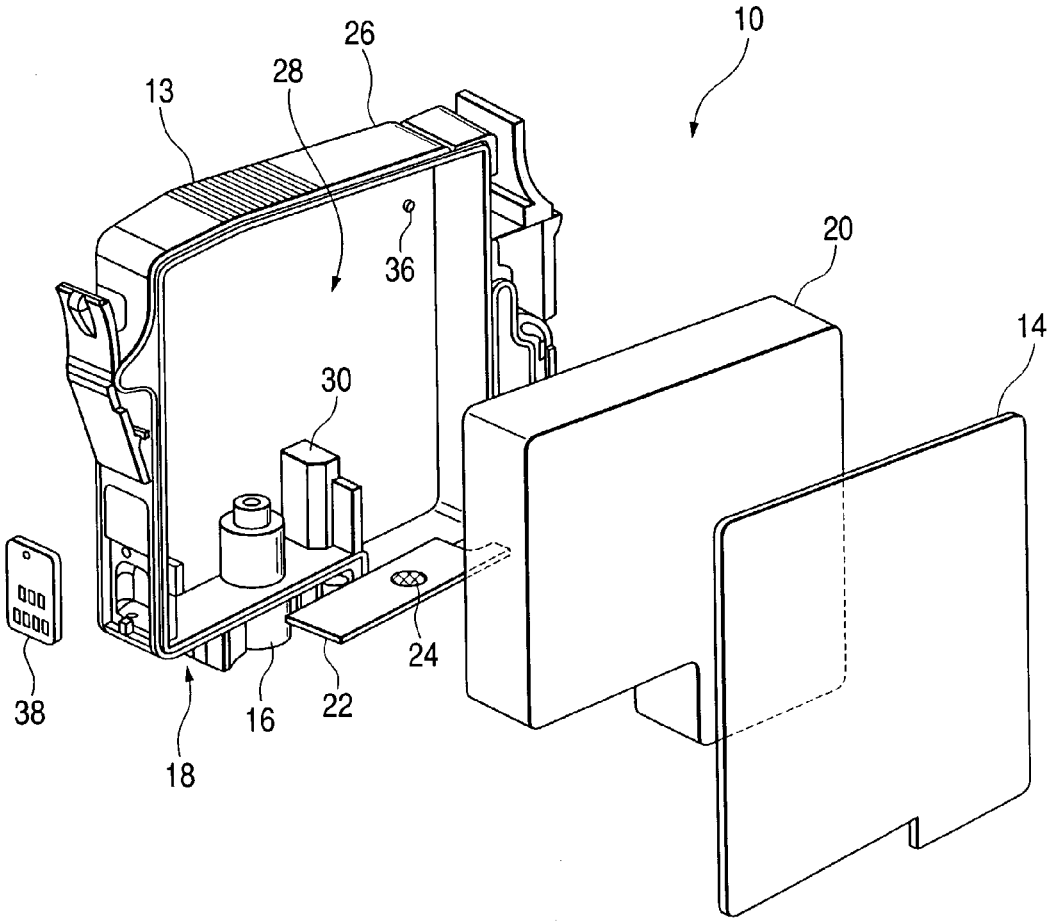
FIG. 3 is an exploded perspective view of the ink cartridge.

FIG. 3 is an exploded perspective view of the ink cartridge 10. The ink cartridge 10 further includes a supply system for supplying ink stored in the ink cartridge body 12 to the ink jet recording apparatus. The ink cartridge 10, as an example in this embodiment, has an ink holding system as the ink supply system. This ink holding system of the ink cartridge 10 includes a foam, such as urethane foam, 20 and a pressure contacting member 22. The foam 20 is housed in a space formed by the container body 13 and the lid member 14. The pressure contacting member 22 is provided in the vicinity of the ink supply passage 16 to extend substantially horizontally.

The container body 13 has an approximately rectangular hexahedron of which one side is opened, and has on the ink supply surface 18 the ink,supply passage 16 communicating from the outside of the container body 13 to the inside thereof. The slit portion 30 forms a convex portion protruding to the inside of the container body 13.

One of side surfaces of the container body 13 having the approximately rectangular hexahedron is open in a width direction thereby to form an opening surface 28. In this embodiment, the opening surface 28 is one of surfaces having the largest area in six surfaces forming the approximately rectangular hexahedron of the container body 13. Therefore, it is easy to insert the foam 20 into the container body 13 from the opening surface 28.

The container body 13 further includes a vent 36 communicating with atmosphere. From this vent 36, air is introduced inside the ink cartridge 10, and ink is supplied through the ink supply passage 16 from the inside of the ink cartridge 10 to the ink jet recording apparatus.

The lid member 14 is a plate-like member having the approximately same shape as the shape of the opening surface 28 of the container body 13. The lid member 14 is welded to the container body 13 and seals the opening surface 28 of the container body 13. The opening surface 28 of the container body 13 may be covered with a film attached to the container body 13, and thereafter the lid member 14 may be welded on its film side. Hereby, the space inside the ink cartridge 10 can be sealed more surely.

The foam 20 has therein many small pores and holds ink in these small pores by capillary force. Though this foam 20 has a shape of a rectangular hexahedron, it is drawn in FIG. 3 in a deformed state where it is pressure contacted by the pressure contacting member 22 to be housed in the container body 13.

The pressure contacting member 22 is a plate-like member arranged on the ink supply passage 16 in parallel with the ink supply surface 18. In this embodiment, the pressure contacting member 22 is a discrete member from the container body 13. However, the invention is not limited to this, but the pressure contacting member 22 may be molded integrally with the container body 13.

The pressure contacting member 22 has in its position corresponding to the ink supply passage 16 a filter 24 through which ink from the foam 20 passes. This filter 24 can filter foreign matter included in the ink and can prevent the foreign matter included in the ink from mixing in the ink jet recording apparatus.

The foam 20 is pressed against the pressure contacting member 22 and inserted into the container body 13, and the foam 20 around the pressure contacting member 22 is compressed. When the foam 20 is compressed, the diameter of the small pores becomes small, and the capillary force becomes stronger; Namely, the compressed portion is stronger in ink holding power than the no-compressed portion. Accordingly, the ink held in the foam 20 is easy to concentrate on the compressed portion around the pressure contacting member 22. Accordingly, the ink is continuously supplied from the foam 20 through the ink supply passage 16 to the ink jet recording apparatus.

The ink cartridge 10 further includes an identification system provided for the ink cartridge body 12 and having data on the supply system for supplying ink to the recording apparatus. In this ink cartridge 10, an IC chip 38, as an example of the identification system, is attached in front of the ink cartridge body 12. The IC chip 38 is constructed, for example, by a circuit board provided with a memory (semiconductor storage device) such as EEPROM. The IC chip has data on ink. As the data on ink, there are, for example, data detecting the existence of the ink cartridge, color of ink stored in the ink cartridge, the amount of residual ink, manufacture year/month/date of the ink cartridge and effectively useable period (expiration time) of the ink cartridge. In the embodiment, the IC chip 38 has, in addition to the data on ink, data on the supply system for supplying the ink to the ink jet recording apparatus. Therefore, the IC chip 38 works as the identification system for identifying the ink supply system.

For example, in the ink cartridge 10 shown in FIGS. 1 to 3, the ink supply system has the ink holding system including the foam 20 and the pressure contacting member 22. The IC chip 38 of this ink cartridge 10 includes data that the supply system of this ink cartridge 10 is the ink holding system.

Figure 4:
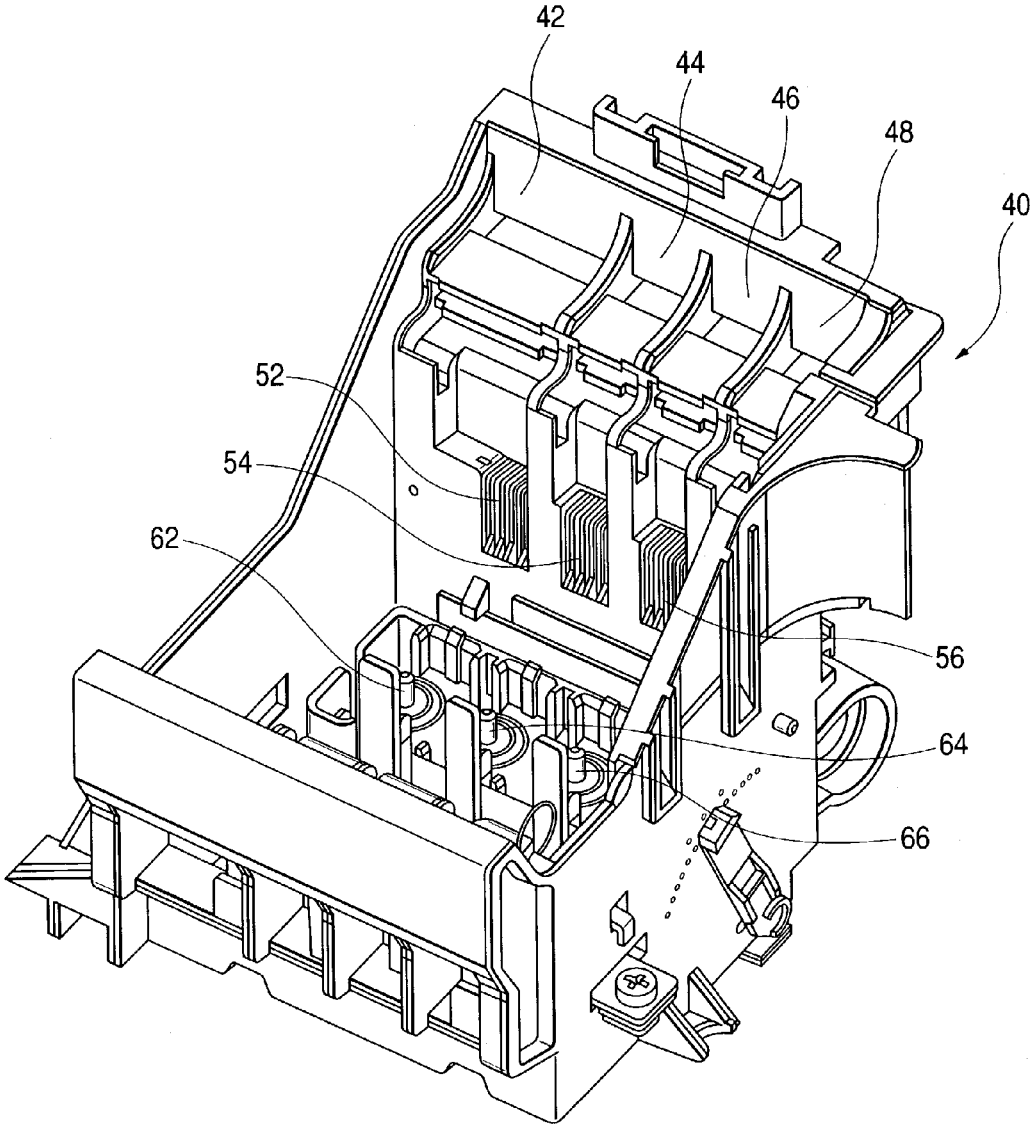
FIG. 4 is a perspective view of a carriage of an ink jet recording apparatus.

FIG. 4 is a perspective view of a carriage 40 of the ink jet recording apparatus according to the embodiment. On the carriage 40, separate ink cartridges storing ink of respective plural colors therein are mounted. In the embodiment, the carriage 40 has a first attachment portion 42 to which a black ink cartridge is attached, a second attachment portion 44 to which a cyan ink cartridge is attached, a third attachment portion 46 to which a magenta ink cartridge is attached, and a fourth attachment portion to which a yellow ink cartridge is attached, in order from a left in the figure.

The first attachment portion 42 of the carriage 40 has, in a position opposed to an IC chip mounted on the black ink cartridge, a first reading portion 52 that reads out data of this IC chip. Similarly, the second attachment portion 44, the third attachment portion 46 and the fourth attachment portion 48 have respectively, in positions opposed to IC chips mounted on the cyan, magenta, and yellow ink cartridges, a second reading portion 54, a third reading portion 56 and a fourth reading portion (58) that read out data of these IC chips. In the embodiment, any of the first to fourth reading portions 52, 54, 56, and 58 is a contact type of reading portion which comes into contact with a terminal of the corresponding IC chip thereby to give and receive data.

The first attachment portion 42 of the carriage 40 has, in a position corresponding to an ink supply passage of the black ink cartridge at its bottom, a first ink supply needle 62. When the black ink cartridge is attached onto the first attachment portion 42, the first ink supply needle 62 enters in the ink supply passage of the black ink cartridge, and the black ink is supplied to the ink jet recording apparatus body. Similarly, the second attachment portion 44, the third attachment portion 46, and the fourth attachment portion 48 have, in a position corresponding to an ink supply passage of each of the cyan, magenta and yellow ink cartridges, a second ink supply needle 64, a third ink supply needle 66 and a fourth ink supply needle (68), respectively.

Figure 5A:
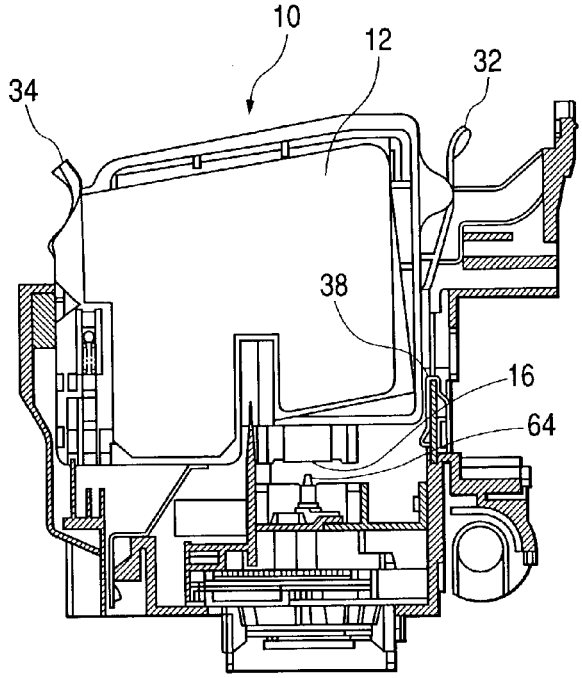
FIGS. 5A and 5B are sectional views for explaining a method by which the ink cartridge is attached onto the carriage.
Figure 5B:
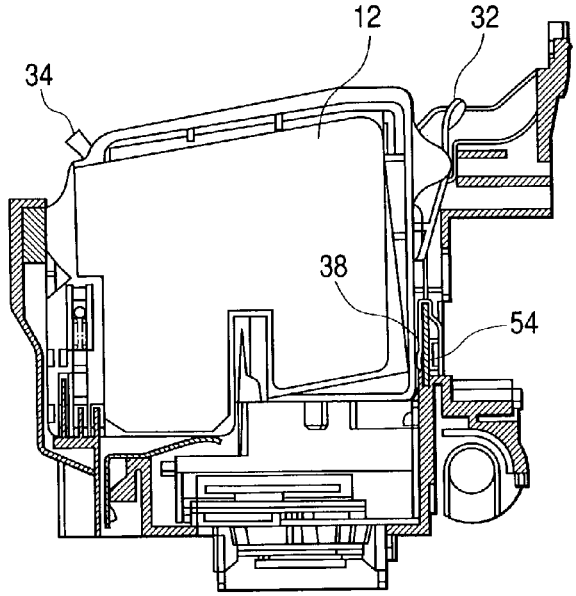

FIGS. 5A and 5B are sectional views explaining a method by which the ink cartridge 10 in this embodiment is attached onto this carriage 40. In this figure, an example in which the ink cartridge 10 storing cyan ink therein is attached onto the carriage is explained.

Firstly, as shown in FIG. 5A, the cyan ink cartridge 10 is inserted into the second attachment portion 44 of the carriage 40 from the upside. When this ink cartridge 10 is further inserted deeply, the ink supply needle 64 of the second attachment portion 44 is inserted into the ink supply passage 16 located on the downside of the ink cartridge body 12. Further, as shown in FIG. 5B, the first and second retaining members 32 and 34 provided on the front and back surfaces of the ink cartridge body 12 are retained onto the carriage 40. Therefore, the ink cartridge 10 is fixed to the carriage 40.

Under the state where the cyan ink cartridge 10 is attached onto the carriage 40, the second reading portion 54 of the second attachment portion 44 in the carriage 40 comes into contact with the IC chip 38 mounted on the cyan ink cartridge body 12.

The second reading portion 54 that has come into contact with the IC chip 38 reads out the data from the IC chip 38 according to request from the ink jet recording apparatus. In this case, the second reading portion 54 works as a judgment system that judges the supply system of the cyan ink cartridge 10 housed in the carriage. Namely, the second reading portion reads, from the IC chip 38, data indicating that the supply system of the ink cartridge 10 uses an ink holding system. The ink jet recording apparatus, on the basis of the read data, can perform optimum control in case that the ink supply system of the attached ink cartridge is the ink holding system.

This control includes control of ink flowing amount, judgment of ink end, head drive of the recording apparatus, and determination of a cleaning method. For example, since the different ink supply systems have respective different ink supply performances, the recording apparatus may be controlled under a suitable drive method selected from plural drive methods preliminarily stored in a recording apparatus memory such that ink consumption speed of the recording head falls within a suitable range (in order to prevent insufficient ink supply from the ink cartridge to the recording head). Also, it is possible to store data regarding the suitable drive method in the IC chip, and to control the recording apparatus based on the stored data. In this case, since it is unnecessary to set or store such data in the recording apparatus memory, it is possible to control the recording apparatus even if a novel ink cartridge is mounted to the recording apparatus.

Figure 6:
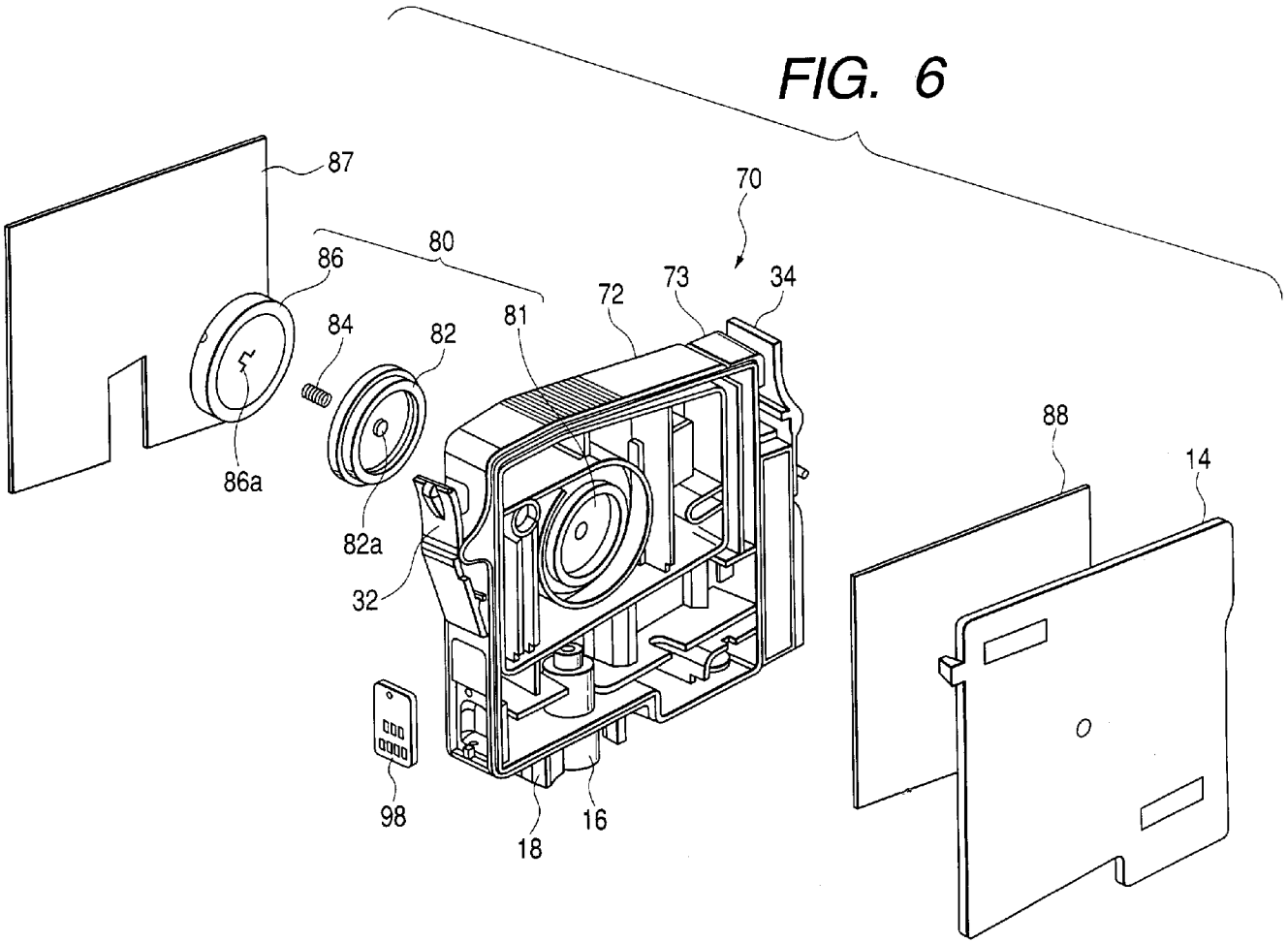
FIG. 6 is an exploded perspective view of another ink cartridge in the first embodiment.

FIG. 6 is an exploded perspective view of another ink cartridge 70 in this embodiment. Since an outline of this ink cartridge 70 is the same as that of the ink cartridge 10 shown in FIGS. 1 and 2, its show and description are omitted. Further, the components in FIG. 6 similar to those in FIGS. 1 and 2 are denoted by the same reference numerals, and their description is omitted.

This ink cartridge 70 has a differential pressure system 80 as an ink supply system. The ink cartridge that supplies ink by the differential pressure system has been disclosed, for example, in Japanese Patent Application No. 2000-147418.

The differential pressure system 80 of the ink cartridge 70 comprises a wall portion 81 recessed on a side of a lid member 14 of a container body 73, a membrane valve 82 housed in a housing chamber formed by the wall portion 81, a lid member 86 for the housing chamber, and a spring 84 of which one end is supported by a spring receiver 82a of the membrane valve 82, and of which the other end is supported by a spring receiver 86*a* of the lid member 86. Further, the ink cartridge 70 has films 87 and 88 adhered to both sides of the container body 73.

Figure 7:
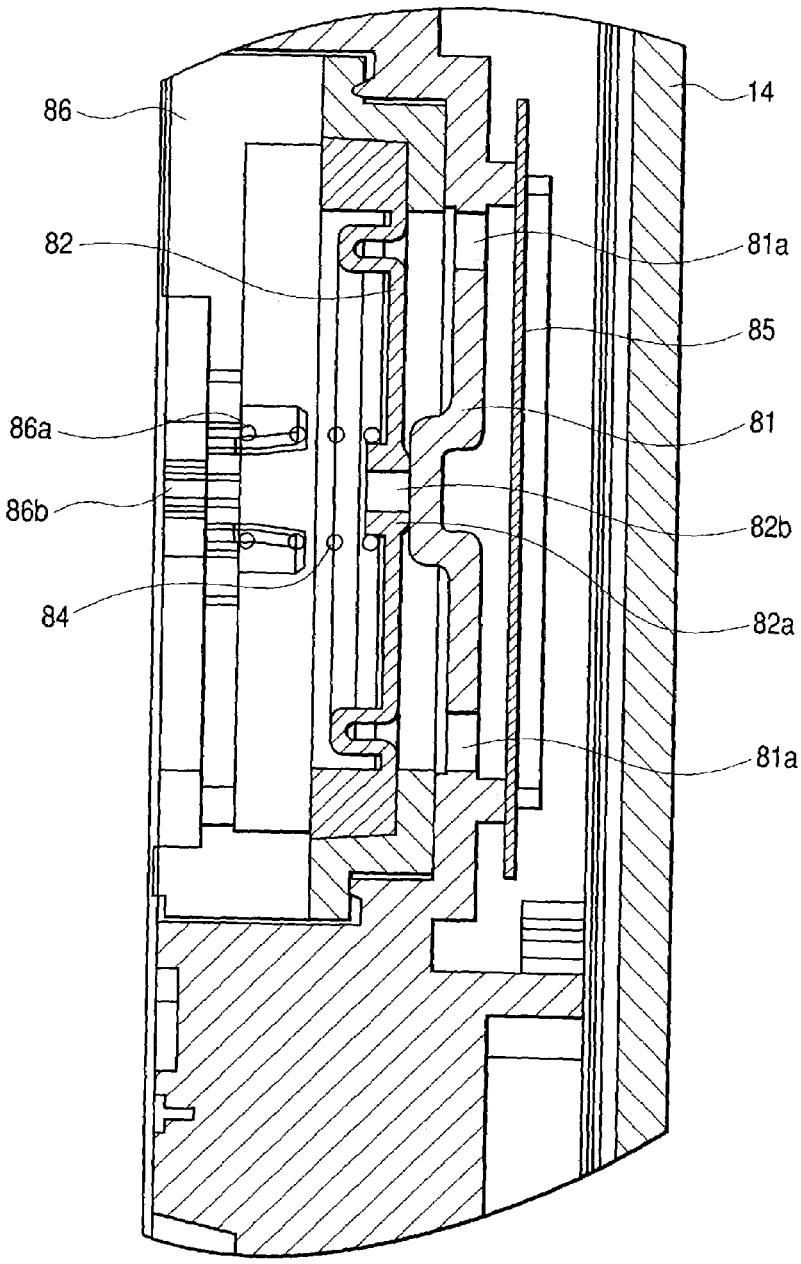
FIG. 7 is an enlarged sectional view of a differential pressure system and its surroundings.

FIG. 7 is an enlarged sectional view of the differential pressure system 80 and its surroundings. The wall portion 81 of the differential pressure system 80 is provided with a filter 85 on the lid 14 side. The wall portion 81 has a communication hole 81*a*. In the center of the membrane valve 82, a communication hole 82*b* is provided. Further, also in the center of the lid member 86, a communication hole 86*b* is provided. The communication hole 86*b* of the lid member 86 connects to an ink supply passage 16 provided on the downside of the ink cartridge body 72.

The spring 84 energizes always the membrane valve 82 against the wall portion 81. Accordingly, under the state shown in FIG. 7, the communication hole 82*b* of the membrane valve 82 comes into contact with the wall portion 81, and flow of ink is shut off. Therefore, the ink is held in the ink cartridge body 72.

When the ink is supplied through the ink supply passage 16 to the ink jet recording apparatus and the pressure on the ink supply passage 16 side decreases, the pressure acting on the membrane valve 82 in the lid member 86 side decreases through the communication hole 86*b* connecting to the ink supply passage 16. When this decrease of pressure becomes large, the membrane valve 82 separates from the wall portion 81 against the energizing force of the spring 84. Consequently, ink which has passed through the filter 85 is supplied to the ink supply passage 16 through the communication hole 81*a* of the wall portion 81, the communication hole 82*b* of the membrane valve 82 and the communication hole 86*b* of the lid member 86.

When the pressure on the ink supply passage 16 side increases, the membrane valve 82 cannot resist the energizing force of the spring 84 and is brought into contact with the wall portion 81. Consequently, the flowing passage of ink is shutoff. By repeating these operations, the ink cartridge 70, while it is keeping the constant negative pressure, can supply the ink from the ink supply passage 16 to the ink jet recording apparatus.

In front of the ink cartridge body 72, an IC chip 98 is attached. This IC chip, similarly to the IC chip 38 in the ink cartridge 10 shown in FIGS. 1 to 3, has data on ink. As the data on ink, for example, there are data of detecting the existence of the ink cartridge, color of ink stored in the ink cartridge, and the amount of the residual ink.

Further, the IC chip 98, in addition to the data on ink, has data on a supply system that supplies ink to the ink jet recording apparatus. In the ink cartridge 70 shown in FIG. 6, the ink supply system has the differential pressure system 60. The IC chip 98 of this ink cartridge 70 includes data that the supply system of this ink cartridge 70 is the differential pressure system. Accordingly, the IC chip 98 works as an identification system for identifying the ink supply system.

This ink cartridge 70, similarly to the ink cartridge 10, is also attached onto a carriage 40 as shown in FIGS. 5A and 5B. For example, in a state where the cyan ink cartridge 70 is attached onto the carriage 40, a second reading portion 54 in a second attachment portion 44 of the carriage 40 comes into contact with the IC chip 98 mounted on the cyan ink cartridge body 72.

The second reading portion 54 that has come into contact with the IC chip 98, according to request from the ink jet recording apparatus, reads out data from the IC chip 98. In this case, the second reading portion 54 works as a judgment system that judges the supply system of the cyan ink cartridge 70 housed in the carriage. Namely, the second reading portion reads, from the IC chip 98, data of indicating that the supply system of the ink cartridge 70 uses the differential pressure system. The ink jet recording apparatus, on the basis of the read data, can perform optimum control in case that the ink supply system of the attached ink cartridge is the differential pressure system. This control includes control of ink flowing amount, judgment of ink end, head drive of the recording apparatus, and determination of a cleaning method.

In the first embodiment, the cyan ink cartridges 10 and 70 are described as examples. However, also in the ink cartridge storing ink of any color, the foregoing is similar.

As described above, according to the first embodiment, the data on ink supply system in the ink cartridge mounted on the carriage is read by the ink jet recording apparatus. Therefore, the optimum control according to the ink supply system can be performed.

In the first embodiment, the IC chip mounted on the ink cartridge body includes the data for judging the ink supply system in addition to the data on ink. However, the invention is not limited to this, but this IC chip itself may include the data for performing the optimum control on the basis of the supply system, for example, control of the ink flowing amount, end judgment of the residual ink amount, head drive of recording apparatus, and determination of a cleaning method. In this case, the recording apparatus reads these data and can perform the optimum control using the read data. For example, it is conceivable to store, in the IC chip, both a first set of control parameters for a first recording apparatus optimized for a foam type ink cartridge and a second set of control parameters for another second recording apparatus optimized for a differential pressure valve type ink cartridge. When the ink cartridge is mounted on the first recording apparatus, the first set of the control parameters are supplied to and read by the first recording apparatus so that the first set of the control parameters are effected on (used to optimize) the control of the first recording apparatus. Similarly, when the ink cartridge is mounted on the second recording apparatus, the second set of the control parameters are supplied to and read by the second recording apparatus so that the second set of the control parameters are effected on (used to optimize) the control of the second recording apparatus. Further, in the first embodiment, the data of indicating whether the ink supply system in the ink cartridge is the ink holding system or the differential pressure system is included. However, the invention is not limited to this. For example, in an ink cartridge using another ink supply system than this ink supply system, data on its ink supply system can be included. Further, data on ink supply performance, such as data on degree of ink holding power in the ink holding system and data on degree of pressure difference of the membrane valve working in the differential pressure system can he also included. That is, the data to be stored in the IC chip may include data indicative of ink supply performance (characteristic of a condition where ink is discharged from the ink supply port) of the ink cartridge, such as an ink flow rate (for example, a maximum ink supply amount per unit time) from the ink cartridge, an ink flow resistance caused during ink supply, a threshold negative pressure value by which ink begins to flow from the ink cartridge, etc.

It is conceivable to store, in the IC chip, each of these data as it is, or to store classification data determined individually based on each of these data or totally based on all of these data. For example, in a case where the ink cartridge is of a foam type, the classification data "1" is stored in the IC chip. In a case where the ink cartridge is of a differential pressure valve type, the classification data "2" is stored in the IC chip. Further, in a case where the ink cartridge is of a biased ink bag type in which an ink bag containing ink therein is housed within a container body of the ink cartridge and a spring or the like is used to apply a biasing force to the ink bag, the classification data "3" is stored in the IC ship. By reading such data, the recording apparatus optimizes various controls correspondingly to the ink supply performance. In this case, the optimum control can be performed more finely. Such data makes it possible to realize finely optimized control of the recording apparatus.

In addition, the chip 38, 98 in this embodiment may include, but not limited to, memory means or memory device disclosed in EP 1 247 651 A.

Figure 8:
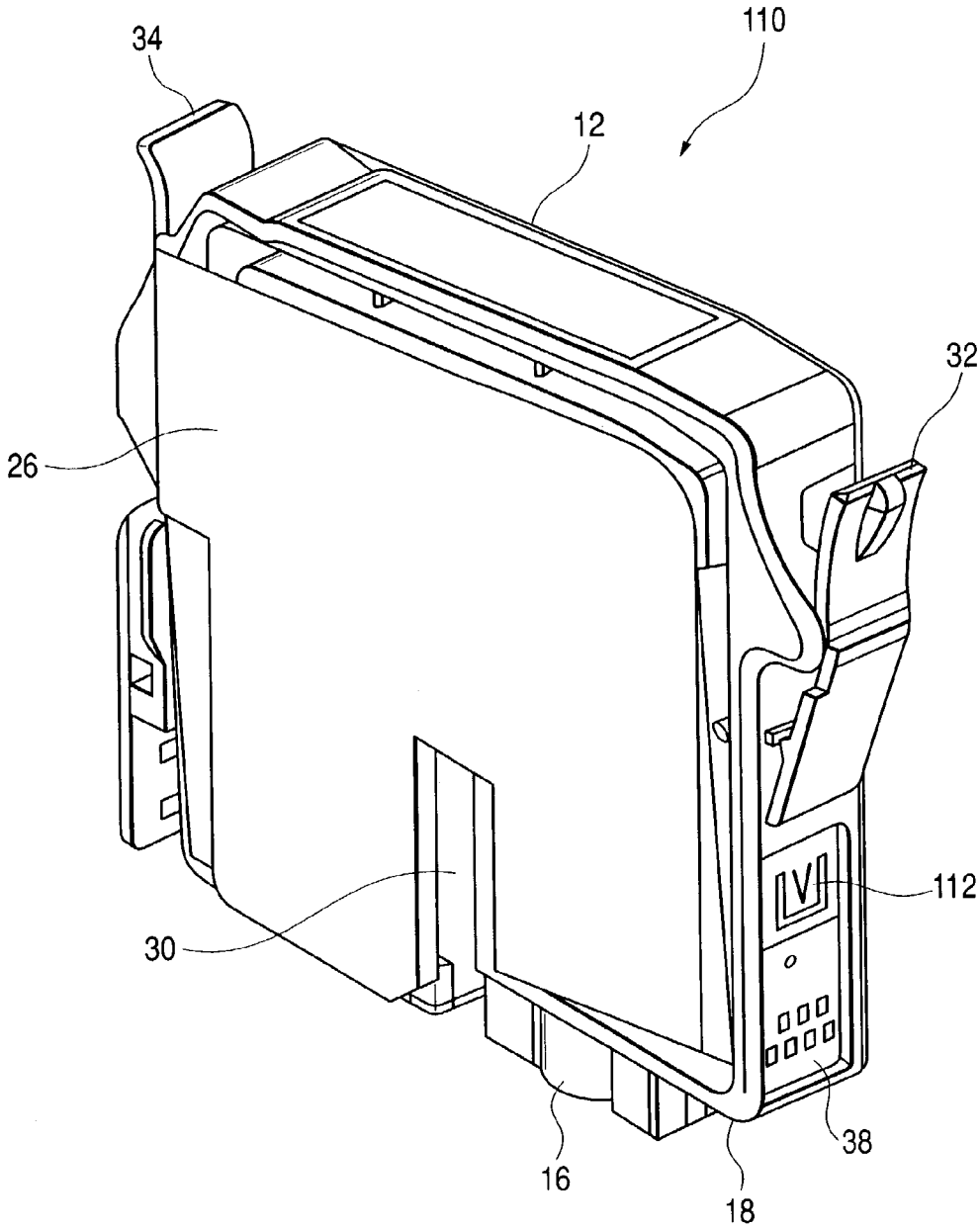
FIG. 8 is a front perspective view of an ink cartridge according to a second embodiment of the invention.

FIG. 8 is a front perspective view of an ink cartridge according to a second embodiment of the invention. This ink cartridge 110 has the similar structure to the structure of the ink cartridge 70 in the first embodiment, but this embodiment is different from the first embodiment in that an identification system constitutes an outline of the ink cartridge. The same components as those in the first embodiment are denoted by the same reference numerals, and their description is omitted.

An ink supply system in the ink cartridge 110 has a differential pressure system 80 similarly to that in the ink cartridge 70. The ink cartridge 110 further has, at the upper portion of an IC chip 38, a claw member 112 that is one example of an identification system. In the embodiment, a character "V" is shown in the claw member 112 so that the user can confirm data of ink supply system by his eyes. Since the ink supply system in the ink cartridge 110 is the differential pressure system including a membrane valve, the first letter of "valve" is shown. However, the invention is not limited to this. If the user can confirm by his eyes that the ink supply system is the differential pressure system, another design may be used.

Figure 9:
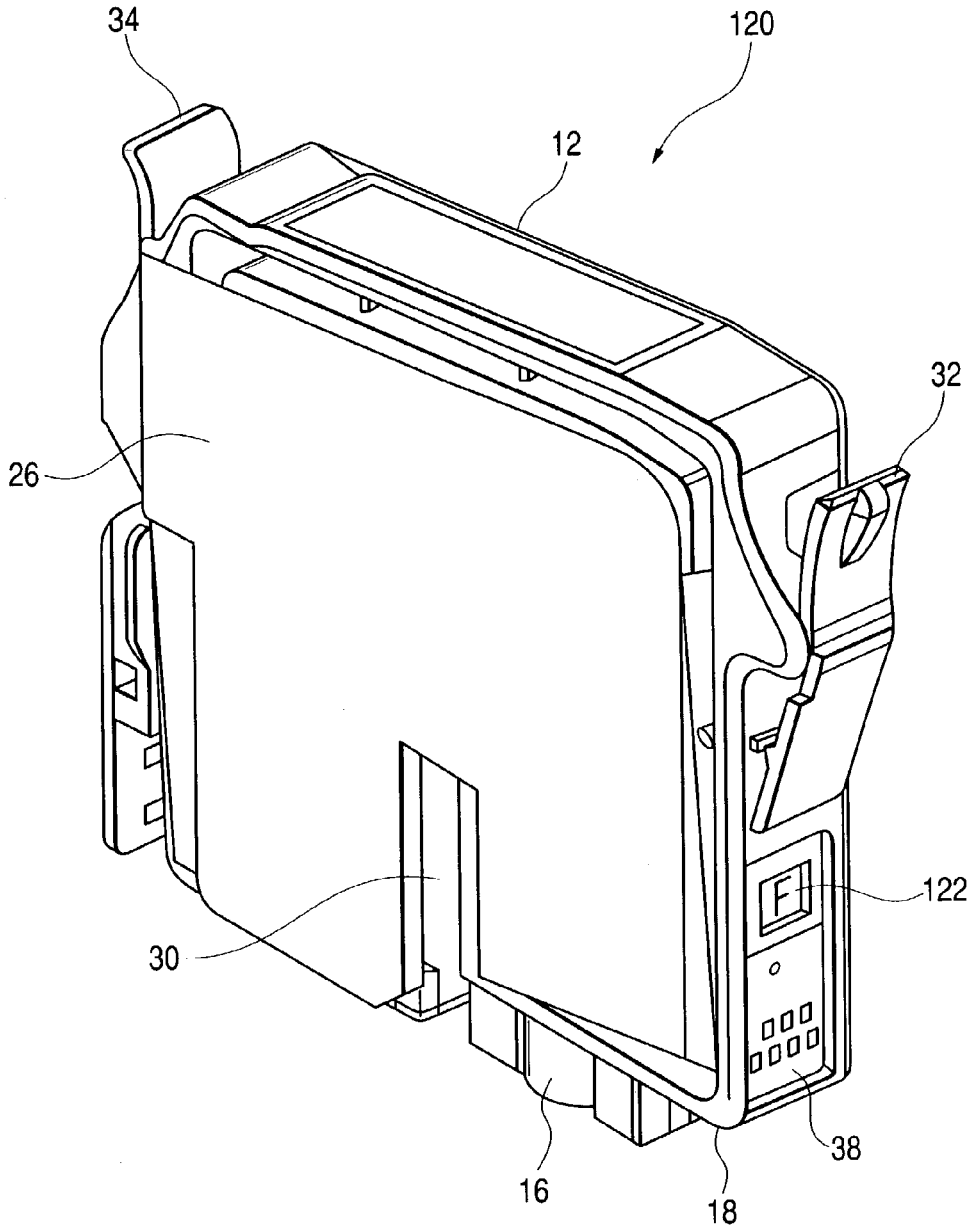
FIG. 9 is a front perspective view of another ink cartridge according to the second embodiment of the invention.

FIG. 9 is a front perspective view of an ink cartridge that is another example according to the second embodiment. In this ink cartridge 120, the claw of the claw member 112 in the ink cartridge 110 is bent and removed. An ink supply system in the ink cartridge 120, similarly to that in the ink cartridge 10 according to the first embodiment, has an ink holding system including a foam 20. In the ink cartridge 120, by bending and removing the claw of the claw member 112, an outline at this portion forms a recess 122 that is another example of the identification system. In the recess 122, a character "F" is shown. Since the ink supply system in the ink cartridge 120 is the ink holding system including the foam 20, the first letter of "foam" is shown. However, the invention is not limited to this. If the user can confirm by his eyes that the ink supply system is the ink holding system, another design may be used.

Figure 10:
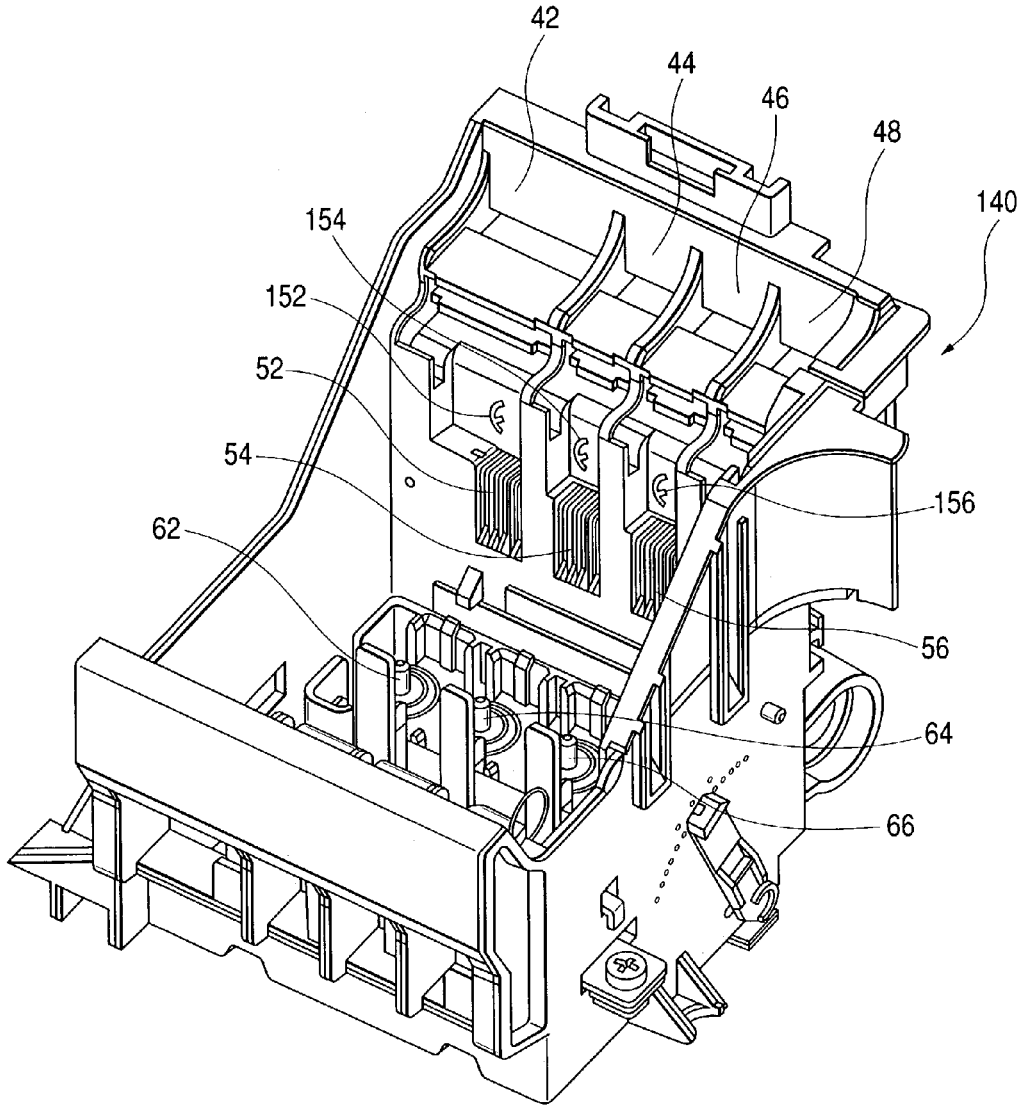
FIG. 10 is a perspective view of a carriage onto which the ink cartridge according to the second embodiment is mounted.

FIG. 10 is a perspective view of a carriage 140 on which the ink cartridge 110 or 120 according to the second embodiment is mounted. The carriage 140 has the same structure as the structure of the carriage 40 according to the first embodiment. However, the carriage 140 is different from the carriage 40 in that outline judging systems 152, 154, 156 and (158) for judging an outline of the ink cartridge are respectively provided for first to fourth attachment portions 42, 44, 46, and 48. The outline judging systems 152, 154, 156 and 158 in the cartridge 140 are respectively provided at the upper portions of first to fourth reading portions 52, 54, 56, and 58. In the carriage 140 in FIG. 10, the same components as those of the carriage 40 in FIG. 4 are denoted by the same reference numerals, and their description is omitted.

Figure 11:
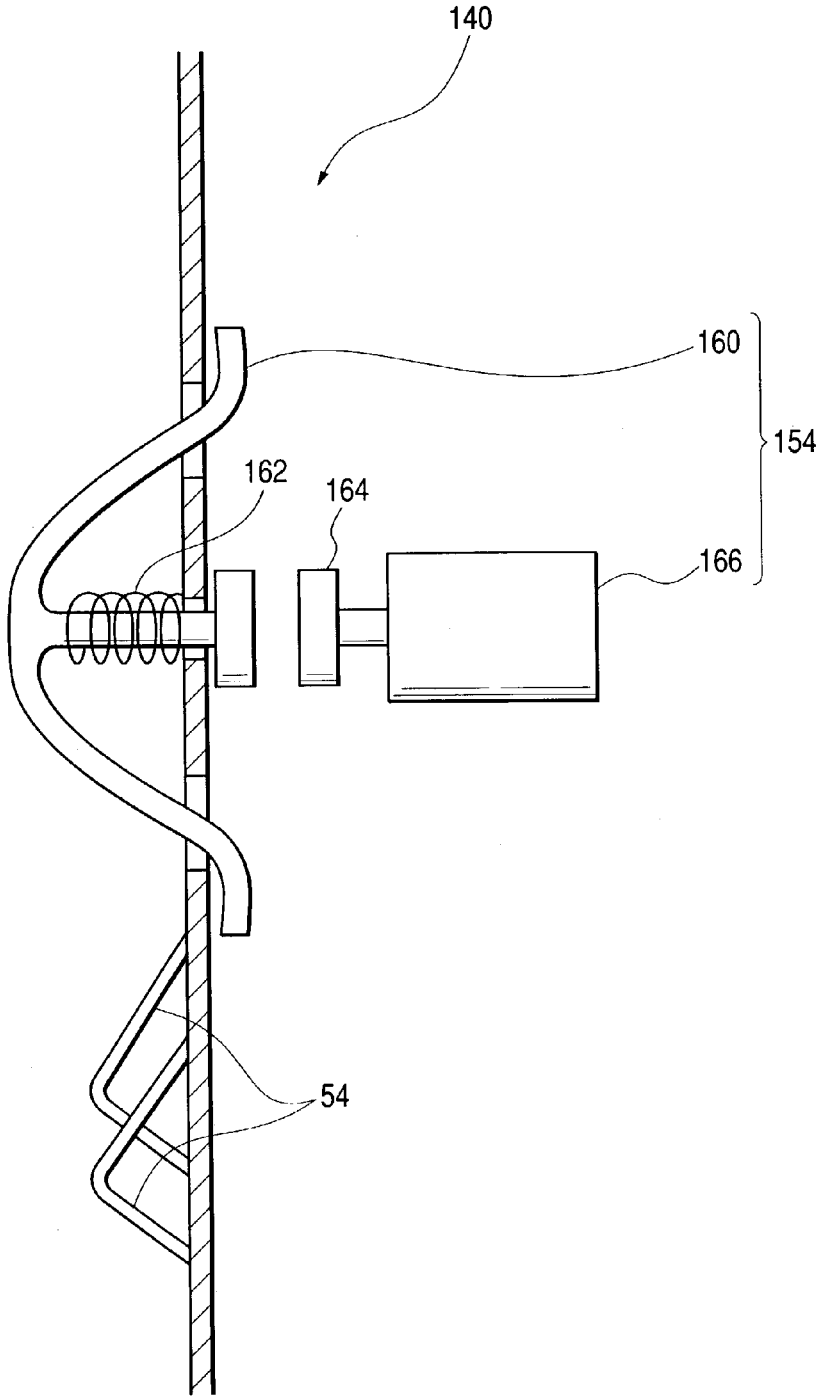
FIG. 11 is an enlarged sectional view of an outline judging system of the carriage and its surroundings.

FIG. 11 is an enlarged sectional view of the outline judging system 154 of the carriage 140 and its surroundings. The outline judging system 154 of the second attachment portion 44 in the carriage 140 will be described below as an example. However, the description of other outline judging systems 152, 156 and 158 is also similar.

The outline judging system 154 comprises a contact piece 160 protruding to the inside of the second attachment portion 44, a spring 162 for energizing the contact piece 160 inward of the second attachment portion 44, and a push switch 166 that switches by push and not-push of a button 164. In a state where the ink cartridge is not attached onto-the carriage 140, the contact piece 160 separates from the button 164 of the push switch 166 by the energizing force of the spring 162.

Figure 12:
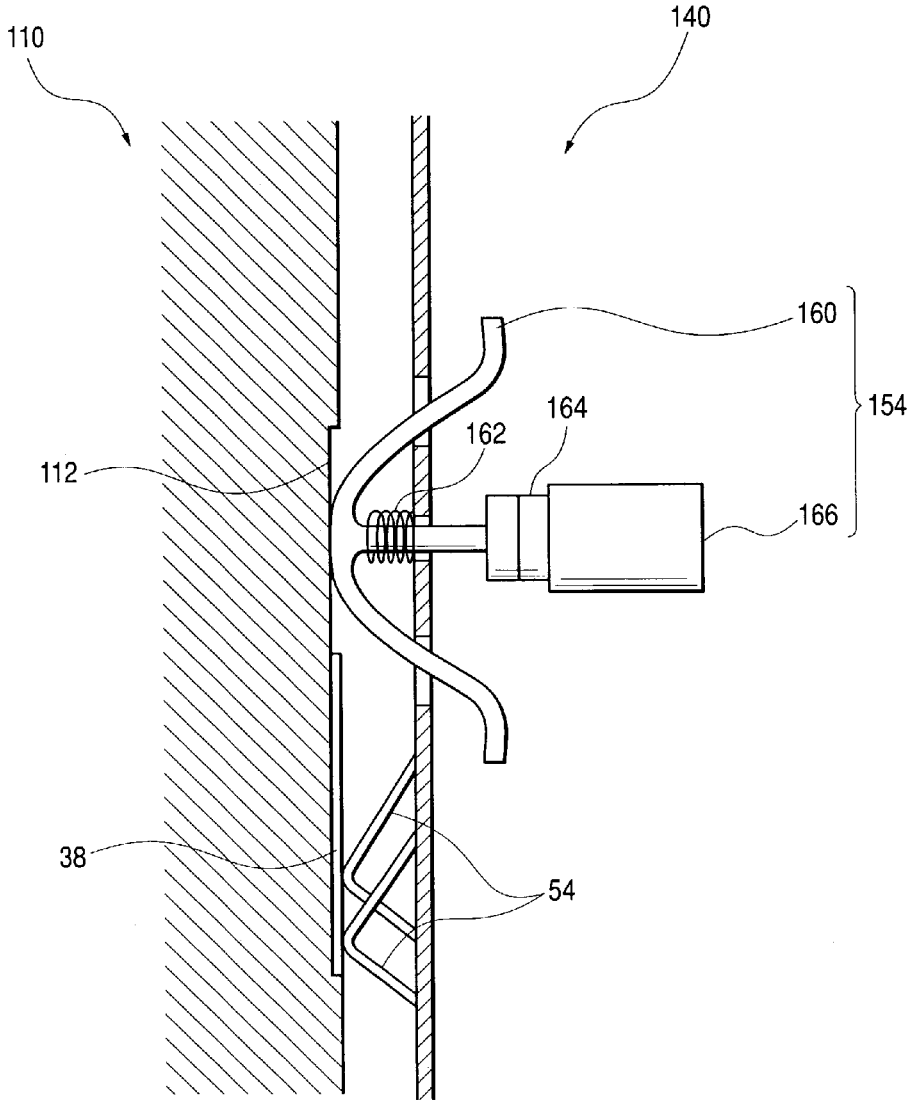
FIG. 12 is an enlarged sectional view of the outline judging system and its surroundings in case that the ink cartridge is mounted on a second attachment portion of the carriage.

FIG. 12 is an enlarged sectional view of the outline judging system 154 and its surroundings in case that the ink cartridge 110 has been attached onto the second attachment portion 44 of the carriage 140. In a state where the ink cartridge is attached onto the second attachment portion 44 of the carriage 140, the claw member 112 comes into contact with the contact piece 160 and pushes the contact piece 160 against the energizing force of the spring 162. Consequently, the contact piece 160 pushes the button 164 of the push switch 166. Accordingly, by output of the push switch 166, it is judged that the ink supply system of the ink cartridge 110 attached onto the second attachment portion 44 of the carriage 140 is the differential pressure system.

Figure 13:
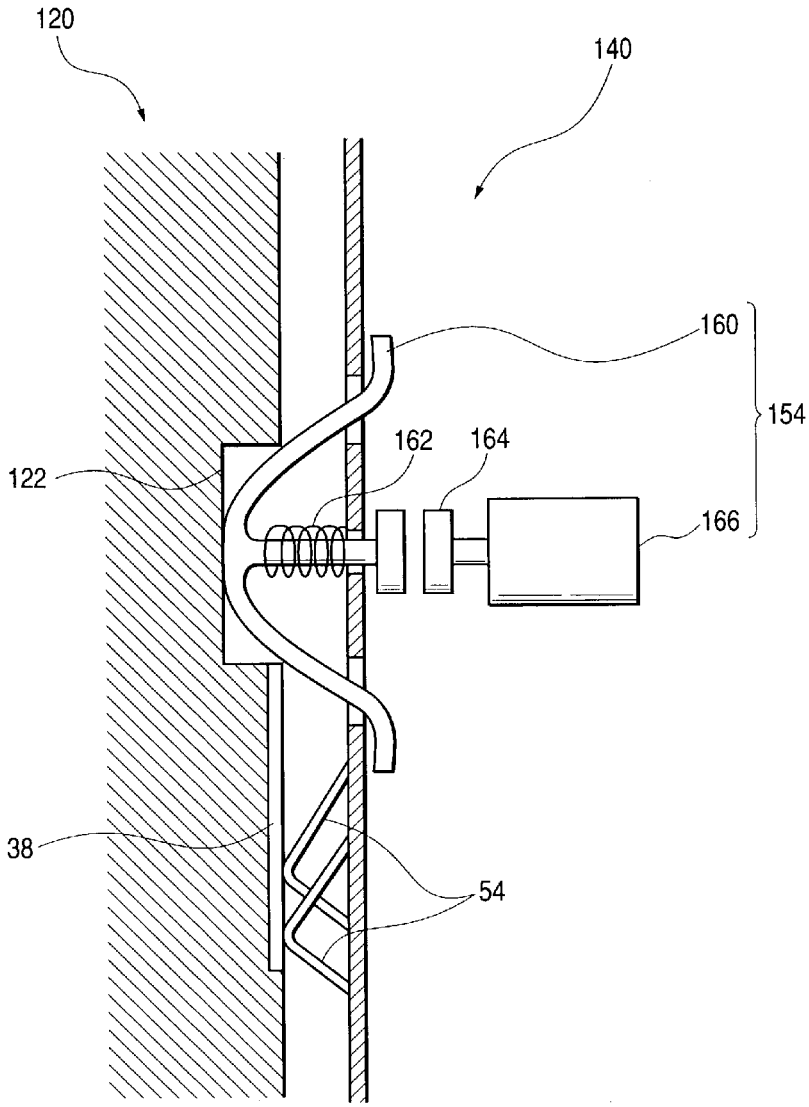
FIG. 13 is an enlarged sectional view of the outline judging system and its surroundings in case that another ink cartridge is mounted on the second attachment portion of the carriage.

FIG. 13 is an enlarged sectional view of the outline judging system 154 and its surroundings in case that another ink cartridge 120 is attached onto the second attachment portion 44 of the carriage 140. FIG. 13 is different from FIG. 12 in that the recess 122 receives the contact piece 160. Accordingly, even in a state where the ink cartridge 120 is attached onto the second attachment portion 44 of the carriage 140, the contact piece 160 does not push the button 164 of the push switch 166. By output of the push switch 166 at this time, it is judged that the ink supply system of the ink cartridge 120 is the ink holding system. In this case, when the second reading system 54 detects that the ink cartridge 120 is attached and the push switch 166 outputs that the button 164 has not been pushed, it may be judged that the ink cartridge 120 has the ink holding system. With this arrangement, it is possible to distinguish between a case that the ink cartridge has not been attached and a case that the ink cartridge has the ink holding system, As described above, according to the second embodiment, the effect similar to that in the first embodiment can be obtained. Further, according to the ink cartridge in the second embodiment, since the ink supply system corresponds to the outline of the ink cartridge, the user can confirm by his eyes the data on ink supply system, which is convenient.

As described above, the invention has been described with reference to the embodiments. However, the technical region of the invention is not limited to the region described in the embodiments. Various change or modification can be added to the above embodiments. It is clear from the description of the scope of the patent claim that embodiments to which such the various change or modification is added are also included in the technical scope of the invention.

As clear from the above description, according to the invention, the data on ink supply system of the ink cartridge attached onto the carriage is read by the ink jet recording apparatus, whereby the optimum control according to the ink supply system can be performed.

What is claimed is:

1. An ink cartridge which supplies ink to a recording apparatus, comprising:

an ink cartridge body for storing said ink therein;

one of an ink holding system and a differental presssure system, which is disposed in the ink cartridge body; and an IC chip mounted on the ink cartridge body, the IC chip storing data indicative of whether the ink holding system is disposed in the ink cartridge.

2. The ink cartridge according to claim 1, wherein the IC chip stores data which specifies ink supply performance of the ink cartridge.

3. The ink cartridge according to claim 2, wherein the data stored in the IC chip specifies at least one of a flow rate of ink per unit time from the ink cartridge, an ink flow resistance caused during ink flow and a threshold of negative pressure value by which ink begins to flow from the ink cartridge.

4. The ink cartridge according to claim 1, wherein the data stored in the IC chip indicates one of numerical values respectively specifying the ink holding system and the differential pressure system.

5. An ink cartridge which supplies ink to a recording apparatus, comprising:

a container storing the ink therein, and having an ink supply port and an air vent port; and an IC chip attached to the container, and storing data indicative of whether a differential pressure valve or a foam is disposed between the ink supply port and the air vent port.

6. An ink cartridge compatible with a first recording apparatus optimized for a foam type ink cartridge and a second recording apparatus optimized for a differential pressure valve type ink cartridge, comprising:

a container storing the ink therein; and an IC chip attached to the container, and storing a first control parameter to be supplied to the first recording apparatus for controlling the first recording apparatus and a second control parameter to be supplied to the second recording apparatus for controlling the second recording apparatus.

7. An ink cartridge, which supplies ink to a recording apparatus, comprising:

a container storing the ink therein, and having an ink supply port;

an IC chip attached to the container, and storing data indicative of a characteristic of a condition where ink is discharged from the ink supply port, wherein the data includes at least one of a flow rate of ink per unit time from the ink cartridge, an ink flow resistance caused during ink flow, and a threshold of negative pressure value by which ink begins to flow from the ink cartridge.

8. The ink cartridge according to claim 7, wherein the IC chip stores data which indicates one of numerical values respectively specifying an ink holding system, a differrential pressure system and an ink bag system to which a biasing force is applicable.

* * * * *